US009044977B2

(12) United States Patent
McLaughlin et al.

(10) Patent No.: US 9,044,977 B2
(45) Date of Patent: Jun. 2, 2015

(54) SYSTEM AND METHOD FOR THREADING A WEB THROUGH A PRINTING DEVICE

(75) Inventors: Matthew R. McLaughlin, Rochester, NY (US); Victoria L. Warner, Caledonia, NY (US); Donald R. Fess, Rochester, NY (US); James L. Giacobbi, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 820 days.

(21) Appl. No.: 13/162,849

(22) Filed: Jun. 17, 2011

(65) Prior Publication Data

US 2012/0321366 A1 Dec. 20, 2012

(51) Int. Cl.

*B65H 20/02* (2006.01)
*B41J 15/16* (2006.01)
*B41J 11/42* (2006.01)

(52) U.S. Cl.

CPC ..... *B41J 15/165* (2013.01); *B65H 20/02* (2013.01); *B65H 2301/52202* (2013.01); *B41J 11/42* (2013.01)

(58) Field of Classification Search

CPC ..... B65H 20/02; B65H 2301/522; B65H 2301/52202
USPC ..... 226/1, 4, 12, 24, 42, 43, 44, 45, 91, 92, 226/111; 242/532.7, 562.1, 563; 400/617
See application file for complete search history.

(56) References Cited

U.S. PATENT DOCUMENTS 2,653,536 A * 9/1953 Cooksey ..... 101/180
3,344,740 A * 10/1967 Hilton ..... 101/228
3,853,256 A 12/1974 Shaffstall
4,011,975 A 3/1977 Brown, Jr.
4,165,029 A 8/1979 Mitchell
4,673,142 A 6/1987 Keene et al.
4,787,546 A 11/1988 Bradbury
4,895,318 A 1/1990 Wulfing
4,896,808 A * 1/1990 Schaede ..... 226/42
4,953,044 A 8/1990 Van Pelt et al.
5,449,156 A * 9/1995 Gnuechtel et al. ..... 270/5.02
5,480,085 A 1/1996 Smithe et al.
5,823,936 A 10/1998 Ratzel
5,996,492 A 12/1999 Jurkewitz et al.
6,010,091 A 1/2000 Leskinen et al.
6,106,177 A 8/2000 Siegl et al.
6,120,428 A 9/2000 Ratzel
6,357,349 B1 3/2002 Tomberlin et al.
6,474,886 B1 11/2002 Sugiyama et al.
6,641,314 B2 11/2003 Mogi
6,681,695 B2 1/2004 Murakami
6,723,206 B1 * 4/2004 Fransson et al. ..... 162/193
7,380,747 B2 6/2008 Fromm et al.
7,395,025 B2 7/2008 Matsuzuki et al.
7,798,382 B2 9/2010 Zentgraf et al.
8,555,761 B2 * 10/2013 Keily et al. ..... 83/343
2003/0116003 A1 * 6/2003 Kapiloff ..... 83/649
2004/0074407 A1 * 4/2004 Iyokawa et al. ..... 101/228
2008/0036141 A1 2/2008 Liu et al.
2008/0058979 A1 3/2008 Nakano
2009/0057362 A1 3/2009 menzinger
2010/0194028 A1 8/2010 Frisque

* cited by examiner

*Primary Examiner* — William E Dondero
(74) *Attorney, Agent, or Firm* — Maginot Moore & Beck LLP

(57) ABSTRACT

A method for assisting the threading of a media web in a continuous feed printer has been developed. The method includes generating an electrical signal that corresponds to a level of tension applied by a media web to a roller positioned along a media path in a printer as the media web travels over the roller. A controller activates at least one actuator to rotate a roller positioned along the media path in response to identifying that the level of tension exceeds a predetermined threshold to facilitate threading of the media web through the printing device.

12 Claims, 2 Drawing Sheets

SYSTEM AND METHOD FOR THREADING A WEB THROUGH A PRINTING DEVICE

TECHNICAL FIELD

This disclosure relates generally to methods for threading a media web through a media path in a printing device, and more particularly to methods for activating one or more rollers to advance the web as the web advances along the media path.

BACKGROUND

Various printing devices include printers that accept individual sheets of pre-cut media or web printers that form images on a continuous web of print media. In a web printer, a continuous supply of media, typically provided in a media roller, is entrained onto rollers that are driven by motors. The motors and rollers pull the web from the supply roller through the printer to a take-up roller. As the media web moves along the media path, the imaging device forms images on the media web that may include text and graphics in one or more colors. Common embodiments of web printing systems include offset lithographic printing systems and inkjet web printing systems.

Installation of a media web in a printer to enable printing on the web requires a threading operation. A threading operation feeds a free end of the web media from the supply roller through the media path to the take-up roller prior to the commencement of printing. A threading operation can occur for various reasons. In some circumstances, a new media web replaces an exhausted media web supply. In other cases, breakage of a media web requires a remaining portion of the web roller that broke or a new web roller to be threaded through the media path. Because some media web printers use different media paths for different print modes, changes in the printing mode for a printer may necessitate a threading operation.

In a typical threading operation, a human operator pulls a free end of the media web through the media path and attaches the free end to the take up roller. Because the media paths in many web printers are long, the media path may make one or more turns through the printer. Manual manipulation of the media web in such printers can be tedious and time consuming. Some existing web printers include one or more manual switches that enable the operator to activate selectively motorized rollers positioned along the media path to assist in pulling the web through various portions of the media path. The selective activation of the motorized rollers still require the operator to pull the free end along and guide the web through the printer while engaging the switches to activate rollers as the free end approaches a still roller. If a switch is not located close enough to the free end of the web, the operator must travel back and forth between the switch and free end of the web. Thus, threading operations can be slow and require extensive operator interaction. Improvements in threading operations that enable more efficient threading of the media web would be beneficial.

SUMMARY

In one embodiment, a method of threading a media web through a media path in a printer has been developed. The method includes generating an electrical signal with a first sensor that corresponds to a level of tension applied by a media web to a roller positioned along a media path in a printer as the media web travels over the roller, and activating with a controller at least one actuator to rotate a roller positioned along the media path in response to the electrical signal generated by the sensor exceeding a predetermined first threshold to facilitate threading of the media web through the printing device.

In another embodiment, a web printing system has been developed. The web printing system includes a plurality of rollers positioned along a media path and configured to engage a media web, a sensor operatively connected to one roller in the plurality of rollers and configured to generate an electrical signal corresponding to a tension applied to the one roller by the media web while the media web is threaded through only a portion of the media path past the one roller, at least one actuator operatively configured to rotate at least one roller in the plurality of rollers, and a controller that is operatively connected to the tension sensor and at the at least one actuator. The controller is configured to identify a level of tension applied to the one roller with reference to the electrical signal, compare the identified level of tension to a first predetermined threshold, and operate the at least one actuator to rotate at least one roller in the plurality of rollers at a threading rotational speed, the threading rotational speed being slower than an operating rotational speed, in response to the identified level of tension exceeding the first predetermined threshold to facilitate threading of the media web through the media path.

DETAILED DESCRIPTION

Figure 1:
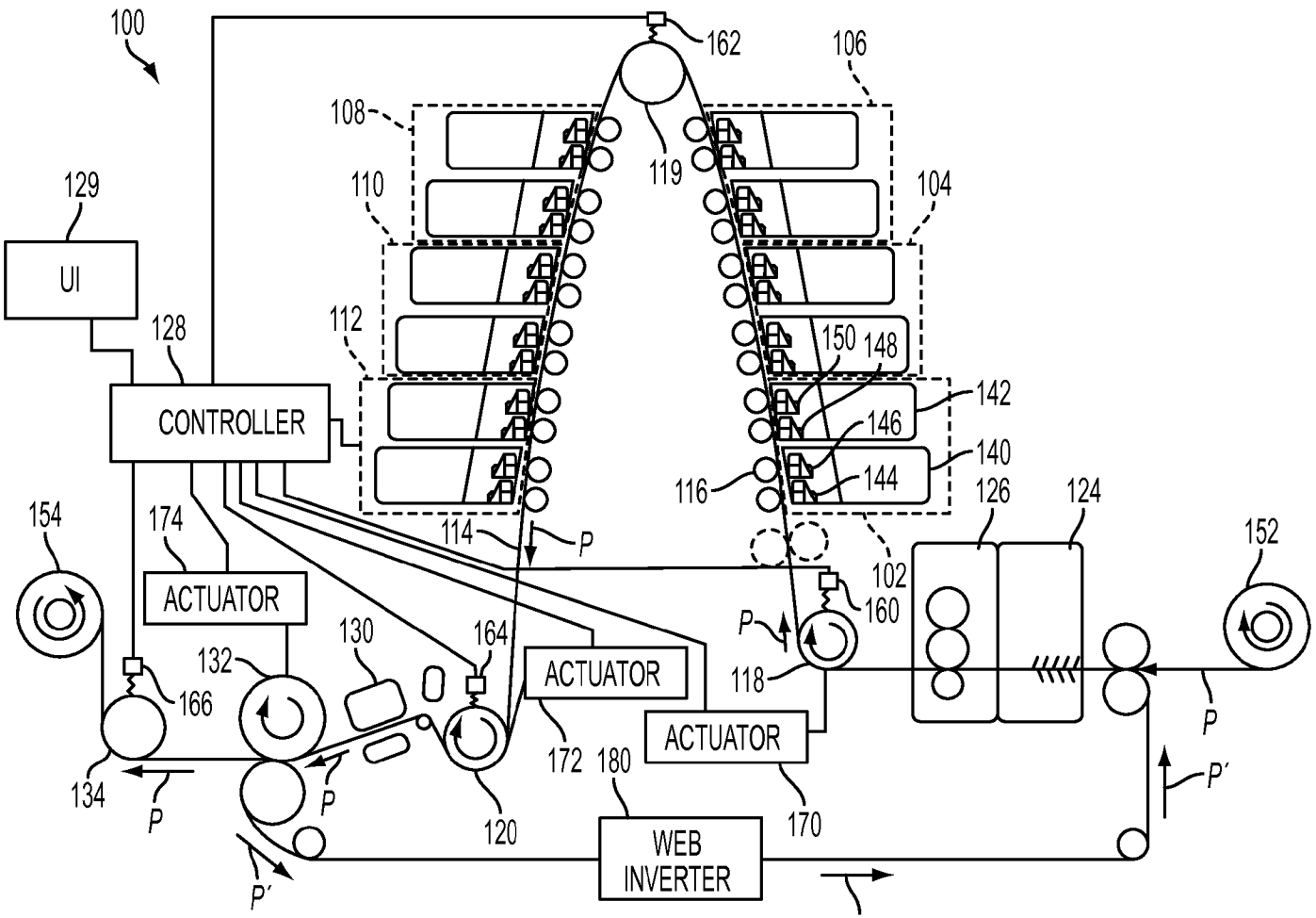
FIG. 1 is a schematic view of a web printing system that is configured to operate one or more actuators to move a media web along a media path.

For a general understanding of the environment for the system and method disclosed herein as well as the details for the system and method, the drawings are referenced throughout this document. In the drawings, like reference numerals designate like elements. As used herein the term "printer" refers to any device that is configured to form images on a print medium including direct imaging printing systems and offset printing systems. As used herein, the term "process direction" refers to a direction of travel of an image receiving member, such a media web along a media path in the printer. The terms "upstream" and "downstream" refer to locations that are more closely positioned to the beginning and end, respectively, of the media path. The term "cross-process direction" is a direction that is perpendicular to the process direction along the surface of the image receiving member. As used herein, the terms "web," "media web," and "continuous media web" refer to an elongated print medium that is longer than the length of a media path that the web traverses through a printer during the printing process. Examples of media webs include rollers of paper or polymeric materials used in package printing. The media web has two sides forming surfaces that may each receive images during printing.

As used herein, the term "rotational speed" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity v for circular members may be represented as: $v=2\pi r\omega$ where r is the radius of the member and ω is the rotational speed or angular velocity of the member.

FIG. 1 depicts a continuous web printer system 100 that includes six print modules 102, 104, 106, 108, 110, and 112; a media path P configured to accept a print medium 114, a controller 128, tension sensors 160, 162, 164, and 166; and actuators 170, 172, and 174. The print modules 102, 104, 106, 108, 110, and 112 are positioned sequentially along a media path P and form a print zone for forming images on a print medium 114 as the print medium 114 moves past the print modules.

In printing system 100, each print module 102, 104, 106, 108, 110, and 112 in this embodiment provides an ink of a different color. In all other respects, the print modules 102, 104, 106, 108, 110, and 112 are substantially identical. Print module 102 includes two print sub-modules 140 and 142. Print sub-module 140 includes two print units 144 and 146. The print units 144 and 146 each include an array of printheads that may be arranged in a staggered configuration across the width of both the first section of web media and second section of web media. In a typical embodiment, print unit 144 has four printheads and print unit 146 has three printheads. The printheads in print units 144 and 146 are positioned in a staggered arrangement to enable the printheads in both units to emit ink drops in a continuous line across the width of media path P at a predetermined resolution.

Print sub-module 142 is configured in a substantially identical manner to sub-module 140, but the printheads in sub-module 142 are offset by one-half the distance between inkjet ejectors in the cross-process direction from the printheads in sub-module 140. The arrangement of sub-modules 140 and 142 enables a doubling of linear resolution for images formed on the media web 114. For example, if each of the sub-modules 140 and 142 emits ink drops at a resolution of 300 drops per inch, the combination of sub-modules 140 and 142 emits ink drops at a resolution of 600 drops per inch.

During a threading operation, a free end of the media web 114 is pulled through the media path P to prepare the printing system to generate images on the media web 114 using the print modules 102-112. The free end of the media web 114 unrolls from a source roller 152 and passes through a brush cleaner 124 and a contact roller 126 prior to entering the print zone. The media web 114 is pulled along the media path P through the print zone guided by a pre-heater roller 118, backer rollers exemplified by backer roller 116, an apex roller 119, and a leveler roller 120. The media web 114 then passes through a heater 130 and a spreader 132 after passing through the print zone. The media web passes an exit guide roller 134 and then winds onto a take-up roller 154. As described in more detail below, as printing system 100 is configured to rotate one or more rollers along the media path P to assist the threading operation. Alternative web printing system configurations may include tension sensors operatively connected to different rollers and other printer components that engage the media web 114 during threading operations.

The media path P depicted in FIG. 1 is exemplary of one media path configuration in a web printing system, but various different configurations may lead the web past different rollers and other components. Printing system 100 also includes a media path P' for an optional duplex web printer configuration. In the duplex configuration, the media web 114 passes through the media path P described above for first-side imaging, and then passes through media path P' and web inverter 180 after passing the spreader roller 132. The web inverter flips the media web 114, and the media web 114 then passes through the entire media path P a second time for imaging of the second side of the media web. After the second side of the media web 114 is imaged, the media web passes the exit guide roller 134 and winds onto the take-up roller 154.

Some of the rollers positioned along the media path P that guide the media web 114 are operatively coupled to one or more actuators that rotate the rollers. The term "drive roller" refers to a roller is operatively coupled to an actuator to enable the actuator to rotate the drive roller. In FIG. 1, actuators 170, 172, and 174 are operatively connected to drive rollers 118, 120, and 132, respectively. The actuators 170-174 may be electrical motors, pneumatic rotary actuators, hydraulic rotary actuators, and the like. In printing system 100, each actuator is operatively connected to a single roller, but in an alternative configuration a single actuator may rotate multiple rollers. The single actuator may rotate the multiple rollers at a single linear and angular velocities, or may engage each roller through a set of gears or transmission that enables the single actuator to rotate various rollers at selected linear and angular velocities.

In the configuration of FIG. 1, each of the drive rollers 118, 120, and 132 engages the media web 114 at different times as the media web is threaded through media path P. Each actuator rotates a corresponding roller to urge the media web along the media path P. For example, actuator 170 rotates the pre-heater roller 118 as shown to pull the media web 114 into the print zone. The actuators 170-174 may rotate the corresponding rollers at different velocities during different operating modes of the printing system 100. During a threading operation, each actuator may rotate the corresponding roller at a predetermined rotational speed to assist in threading the media web 114. In the embodiment of FIG. 1, the drive rollers 118, 120, and 132 rotate at lower angular velocities during threading operations than during imaging operations.

In FIG. 1, some rollers positioned along the media path are operatively connected to sensors that generate electrical signals corresponding to a level of tension force exerted by the media web 114 on the roller. Examples of suitable sensors include load cells and strain gauges. In FIG. 1, sensors 160, 162, 164, and 166 are operatively connected to the pre-heater roller 118, apex roller 119, leveler roller 120 and exit guide roller 134, respectively. The sensors 160-166 generate electrical signals that correspond to a tension force between the corresponding rollers and the media web 114. During a threading operation, the sensors 160-166 generate signals corresponding to the tension between the media web and the corresponding rollers that indicate that the corresponding rollers are in contact with the media web 114.

In the embodiment of FIG. 1, the pre-heater roller 118 is operatively connected to sensor 160 and actuator 170, and the leveler roller 120 is operatively connected to sensor 164 and actuator 172. Rollers 118 and 120 are examples of a single roller coupled to a sensor for measuring tension between the roller and the media web, and an actuator that rotates the roller. The apex roller 119 and exit guide roller 134 are operatively connected to sensors 162 and 166, respectively, but are not directly connected to an actuator. Rollers 119 and 134 are examples of rollers contact the media web 114, but are not directly rotated by an actuator. The spreader roller 132 is operatively connected to actuator 174, but is not directly connected to a tension sensor. Alternative printing system configurations may include rollers and other moving members along a media path that are connected to a sensor, an actuator, or a combination of both a sensor and actuator.

Controller 128 is configured to control various subsystems, components and functions of printing system 100. The controller 128 may be implemented with general or specialized programmable processors that execute programmed instructions. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Controller 128 is operatively coupled to the print modules 102-112 and controls the timing of ink drop ejection from the print modules 102-112 onto the media web 114. Controller 128 is also operatively connected to sensors 160-166 that enable the controller 128 to identify tension between the media web 114 and rollers 118, 119, 120, and 134 from the signals generated by each sensor. Controller 128 is also operatively connected to actuators 170-174. The controller 128 generates signals to selectively activate and deactivate each of the actuators 170-174. The controller 128 may also adjust the speed of each actuator and corresponding rotational speed of one or more rollers that are operatively coupled to each actuator.

A user interface (UI) module 129 provides an interface for operators of the printing system 100 to set different operating modes for the controller 128. Various implementations of the UI include mechanical controls such as knobs, switches, dials and the like, as well as graphical user interfaces (GUIs). The UI may be physically incorporated in the printing system 100, or may be presented to a remote operator via a data network. An operator may enter various commands and parameters using the UI 129 to configure the operation of the controller 128. In printing system 100, the UI 129 enables the operator to place the controller 128 in an operating mode for threading the media web 114 through the media path P. The controller 128 may also enter a threading mode automatically in response to exhausting an existing media web or by detecting breakage of the media web.

In the threading operational mode, the controller 128 receives signals from each of the sensors 160-166 to identify tension levels between the media web and the rollers 118, 119, 120, and 134, respectively. The controller 128 compares the identified tension levels to predetermined threshold levels, and rotates one or more of the drive rollers 118, 120, and 132 by operating actuators 170, 172, and 174, respectively, in response to the identified tension levels exceeding the predetermined thresholds. The drive rollers 118, 120, and 132 rotate to assist in threading the media web 114 through the media path P as the operator pulls the media web through the printing system 100 without requiring the operator to operate separate controls during the threading operation.

Figure 2:
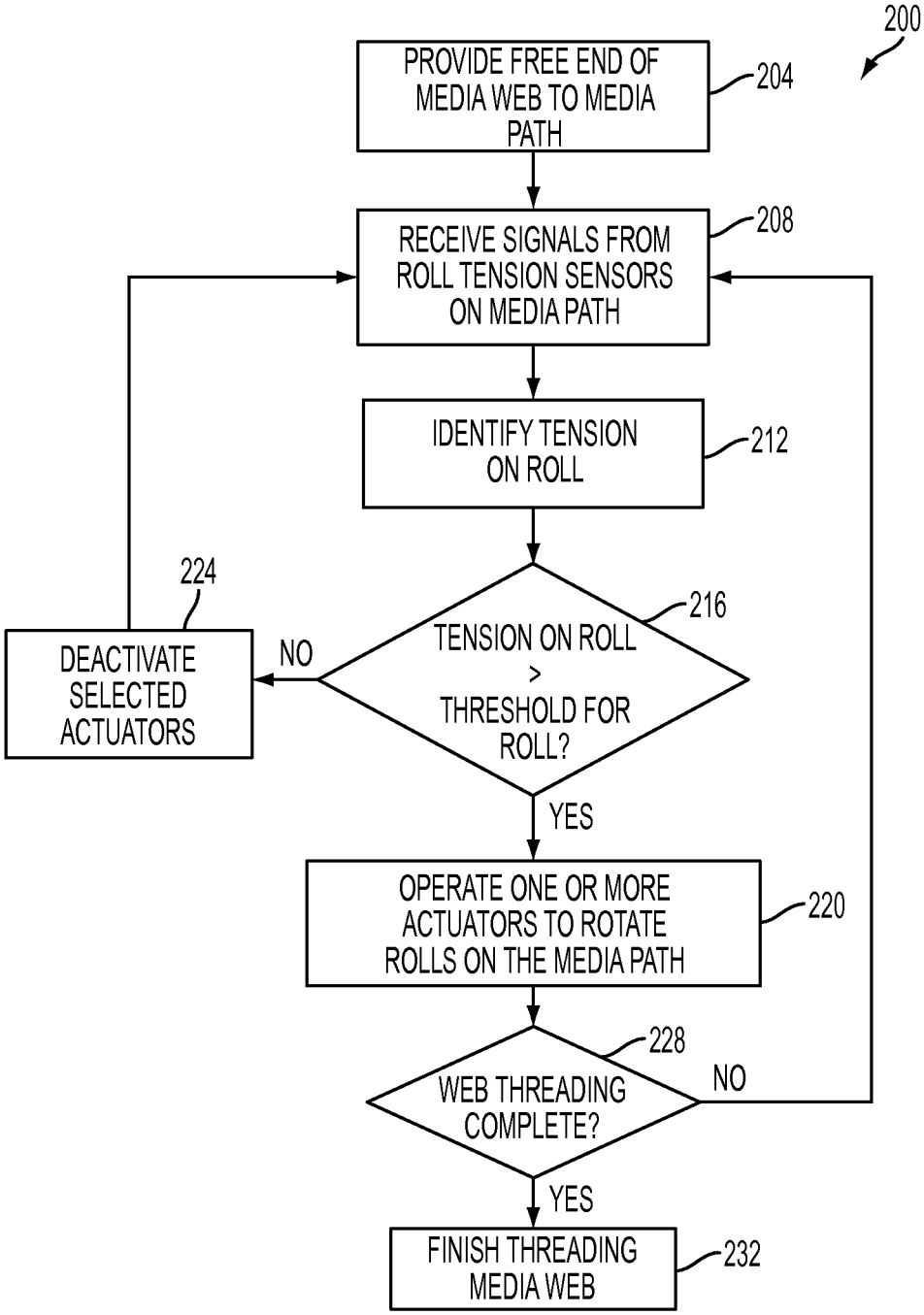
FIG. 2 is a block flow diagram of a process for operating one or more actuators in a web printing system to assist in threading a media web through the web printing system.

FIG. 2 depicts a block diagram of a process 200 for operating a printing system to assist in threading a media web through the printing system. Process 200 is suitable for use with the printing system 100 of FIG. 1, and printing system 100 is described in conjunction with process 200 for illustrative purposes. Process 200 begins by providing a free end of a media web 114 to a media path P (block 204). The free end of the media web 114 is unwound from a media web supply roller, such as roller 152. The operator pulls the media web through the media path and engages the media web with a roller along the media path that is operatively connected to a tension sensor, such as the pre-heater roller 118.

As the media web 114 passes the pre-heater roller 118, the media web applies a tension to the pre-heater roller 118. Sensor 160 generates an electrical signal corresponding to the level of tension between the media web 114 and pre-heater roller 118, and the controller 128 receives the signal (block 208). Controller 128 identifies the tension on the roller 118 from the generated signal (block 212). In some embodiments, the controller 128 may identify the tension with reference to a voltage level of the signal.

If the identified tension level exceeds a predetermined threshold for roller 118 (block 216) the controller 128 operates one or more actuators in the printing system 100 to rotate rollers positioned along the media path P (block 220). As the media web 114 engages the pre-heater roller 118 and applies sufficient tension to the pre-heater roller 118, the controller may operate actuator 170 to rotate the pre-heater roller 118. The rotation of the pre-heater roller 118 pulls the media web 114 along the media path P and assists the operator in threading the media web 114 into the print zone past the print modules 102-106.

The controller 128 continues to receive signals from the sensor 160 (block 208) and monitors the tension on the pre-heater roller 118 (block 212) as actuator 170 rotates the pre-heater roller 118. If the level of tension on the pre-heater roller 118 drops below the predetermined threshold (block 216), the controller 128 may deactivate actuator 170 until the identified tension level exceeds the predetermined threshold (block 224). The controller 128 deactivates the actuator 170 when the tension level drops below the predetermined threshold to prevent the pre-heater roller 118 from unwinding the media web 114 too quickly during the threading process. As the media web threads past different rollers positioned on the media path, the controller 128 may deactivate one or more actuators in response to identifying the tension level between the media web 114 and any roller in contact with the media web dropping below the predetermined threshold for each roller. In an alternative configuration, the controller 128 may operate the actuator 170 for a predetermined time period in response to the sensor signal corresponding to a tension level that exceeds the predetermined threshold.

Process 200 continues as the media web 114 passes each roller positioned on the media path (block 228). In printing system 100, the media web 114 threads through the print zone past print units 102-106 and over apex roller 119. The apex roller 119 is not rotated by an actuator directly, but the controller 128 identifies the level of tension placed on apex roller 119 from the electrical signals generated by sensor 162 (blocks 208 and 212). The controller 128 operates actuator 170 to rotate the pre-heater roller 118 in response to the tension on the apex roller 119 exceeding a predetermined threshold (block 216). The predetermined threshold tension on the apex roller 119 may be different than the predetermined threshold tension on the pre-heater roller 118. For example, the predetermined threshold tension level on the pre-heater roller 118 may be five Newtons while the predetermined threshold tension level on the apex roller 119 is six Newtons.

In one embodiment, the controller 128 is configured to operate the one or more actuators based on the identified tension levels for all the sensors 160-166 that indicate non-zero tension values. In another embodiment, the controller 128 operates the actuators only with regard to the level of tension applied to a roller that is farthest along the media path P. The controller 128 operates the actuators to rotate the corresponding rollers at a lower rotational speed during the process 200 than during imaging operations when the media web 114 is fully threaded in the printing system 100. In some configurations, the controller 128 adjusts the rotational speed of one or more of the drive rollers 118, 120, and 132 in proportion to the tension detected by the tension sensors 160-166.

In one threading process, a human operator pulls on a free end of the media web 114, applying tension to the media web. The tension sensors 160-166 may record potentially spurious tension signals dues to inconsistencies in the force that the human operator applies to the media web 114. Additionally, the tension force identified by the tension sensors 160-166 changes as human applies greater or lesser forces to the media web 114. In one embodiment, the controller 128 is configured to identify spurious tension forces applied to rollers in the printing system 100. For example, an operator may lean against a roller during the threading process, resulting in a spurious tension measurement. The controller 128 is configured to identify a maximum expected tension for each of the tension sensors during the threading operation, and can prevent the activation of a corresponding actuator if the recorded tension exceeds the maximum expected tension.

In some configurations, the controller 128 activates one or more actuators only in response to a predetermined series of signals generated by one or more of the tension sensors 160-166. In one configuration, the controller 128 activates one or more actuators only when a tension sensor detects two tension pulses above a predetermined threshold within a predetermined time period. For example, if the tension sensor 160 detects two tension pulses that are separated by less than three seconds from an operator who pulls on the free end of the media web 114, then the controller 128 operates the actuator 170 to advance the media web 114.

Referring to printing system 100, as the media web 114 threads over the apex roller 119, sensor 162 generates an electrical signal corresponding to the tension between the media web 114 and the apex roller 119. The media web 114 has not yet reached the leveler roller 120 and exit guide roller 134, so sensors 164 and 166 indicate zero tension. The controller 128 may be preconfigured to assign precedence to media rollers based on the location of the media rollers along the media path P, with media rollers that are located at more downstream positions receiving a higher precedence. Thus, controller 128 may identify a non-zero tension signal generated by tension sensor 162 coupled to the apex roller 119, and operate the actuator 170 in response to the tension signal from the sensor 162 exceeding the predetermined tension threshold for apex roller 119. Additionally, the controller 128 may deactivate one or more actuators if the tension level identified for apex roller 119 drops below the predetermined threshold (block 224). In some configurations, the controller 128 continues to operate the actuators for a predetermined time after tension drops below the predetermined threshold. The continued operation of the actuators assists an operator during a threading operation when the operator momentarily reduces the force applied to the media web 114.

Process 200 continues as the free end of media web 114 is threaded through print units 108-112 and the media web engages the leveler roller 120. The media web applies tension to the leveler roller 120 and sensor 164 generates a signal corresponding to the tension. The controller 128 receives the signal and identifies the level of tension (blocks 208 and 212). If the tension identified for roller 120 exceeds the predetermined tension threshold for roller 120 (block 216), the controller 128 activates both actuators 170 and 172 to rotate drive rollers 118 and 120, respectively (block 220). In the example of printing system 100, the media web 114 contacts both drive rollers 118 and 120 during the threading process, and the controller 128 is configured to operate both actuators 170 and 172 to assist in the threading process.

Process 200 continues in a similar manner as described above for threading the media web past the spreader roller 132 and exit guide roller 134. When the media web engages the exit guide roller 134, sensor 166 generates a signal corresponding to a level of tension between the media web 114 and the exit guide roller 134, and the controller 128 identifies the tension level (blocks 208 and 212). If the identified tension level exceeds the predetermined tension threshold for roller 134 (block 216), the controller 128 activates actuators 170, 172, and 174 to assist in guiding the media web 114 through the media path P (block 220). The free end of the media web 114 is wound around the take-up roller 154, and process 200 finishes when the media web 114 is fully threaded through the printing system 100 (block 232).

The foregoing description of process 200 as applied to printing system 100 is merely an illustrative example of a printing system configuration that assists an operator in threading a media web through a media path. The media web 114 may be threaded through the duplex path P' and then guided through the media path P at a cross-process offset position a second time to enable duplex printing. The controller 128 is configured to operate the actuators 170-174 to assist in threading the media web 114 through the duplex configuration as well as the simplex configuration. Process 200 is also suitable for use with printing systems having different numbers and arrangement of rollers, sensors, and actuators positioned along a media path than the examples described herein.

It will be appreciated that variants of the above-disclosed and other features and functions, or alternatives thereof, may be desirably combined into many other different systems, applications or methods. For example, while the printing system embodiments described above are inkjet printing systems, the foregoing systems and methods are applicable to any printing system where a continuous web is threaded through a media path. Various presently unforeseen or unanticipated alternatives, modifications, variations or improvements may be subsequently made by those skilled in the art that are also intended to be encompassed by the following claims.

What is claimed:

1. A method of threading a media web through a media path in a printer having a plurality of rollers positioned along the media path comprising:

generating an electrical signal with a first sensor that varies with reference to a level of tension applied by the media web to a first roller in the plurality of rollers positioned along the media path in the printer as the media web travels over the first roller;

activating with a controller at least one actuator to rotate the first roller in the plurality of rollers positioned along the media path at a rotational speed proportional to the signal generated by the first sensor that varies with reference to the level of tension applied by the media web to the first roller in response to the electrical signal generated by the first sensor exceeding a first predetermined threshold to facilitate threading of the media web past the first roller; and activating with the controller another actuator to rotate a second roller in the plurality of rollers positioned along the media path at a rotational speed that varies with reference to a level of tension applied by the media web to the second roller to facilitate threading of the media web past the second roller.

2. The method of claim 1, the activation of the at least one actuator further comprising:

activating the at least one actuator for a predetermined time period.

3. The method of claim 1 further comprising:

deactivating the at least one actuator with the controller in response to the electrical signal generated by the first sensor corresponding to a level of tension that is less than the first predetermined threshold after the electrical signal generated by the first sensor has exceeded the first predetermined threshold.

4. The method of claim 1 further comprising:

generating a second electrical signal with a second sensor that varies with reference to the level of tension applied by the media web to the second roller in the plurality of rollers by the media web; and the controller is further configured to rotate the second roller in the plurality of rollers positioned along the media path at the rotational speed that varies with reference to the level of tension applied by the media web to the second roller in response to the second electrical signal generated by the second sensor that varies with reference to the level of tension applied by the media web to the second roller exceeding a second predetermined threshold.

5. The method of claim 4 wherein the second predetermined threshold is different than the first predetermined threshold.

6. A method of threading a media web through a media path in a printer comprising:

applying tension to a free end of the media web to thread the media web past a first roller arranged along the media path in the printer;

generating with a first sensor an electrical signal that varies with reference to a level of tension applied by the media web to the first roller as the media web is threaded past the first roller;

operating a first actuator with a controller to rotate a first roller positioned along the media path at a rotational speed proportional to the electrical signal generated by the first sensor that varies with reference to the level of tension applied by the media web to the first roller to facilitate threading the media web past the first roller in response to the electrical signal generated by the first sensor exceeding a predetermined first threshold level of tension;

applying tension to the free end of the media web to thread the media web past a second roller arranged along the media path in the printer;

generating with a second sensor a second electrical signal that varies with reference to a level of tension applied by the media web to the second roller as the media web is threaded past the second roller; and operating a second actuator to rotate a second roller positioned along the media path at a rotational speed proportional to the electrical signal generated by the second sensor that varies with reference to the level of tension applied by the media web to the second roller in response to the second electrical signal generated by the second sensor that varies with reference to the level of tension applied by the media web to the second roller exceeding a predetermined second threshold to facilitate threading of the media web past the second roller.

7. The method of claim 6 wherein the first actuator rotates the first roller at a rotational speed that is slower than a rotational speed of the first roller when the media web is fully threaded through the media path.

8. A web printing system comprising:

a plurality of rollers positioned along a media path through the web printing system and configured to engage a media web;

a first sensor operatively connected to a first roller in the plurality of rollers and configured to generate an electrical signal that varies with reference to a tension applied to the first roller by the media web;

at least one actuator operatively configured to rotate the first roller in the plurality of rollers;

another actuator configured to rotate a second roller in the plurality of rollers; and a controller operatively connected to the first sensor, the at least one actuator and the other actuator, the controller being configured to identify a level of tension applied to the first roller with reference to the electrical signal that varies with reference to the level of tension applied to the first roller, compare the identified level of tension to a first predetermined threshold, operate the at least one actuator to rotate the first roller in the plurality of rollers at a rotational speed proportional to the electrical signal generated by the first sensor that varies with reference to the level of tension applied by the media web to the first roller, the rotational speed being slower than an operating rotational speed, in response to the identified level of tension exceeding the first predetermined threshold, and to operate the other actuator to rotate the second roller at a rotational speed that varies with reference to a tension applied by the media web to the second roller to facilitate threading of the media web past the second roller.

9. The web printing system of claim 8, the controller being further configured to operate the at least one actuator to rotate the first roller for a predetermined time period.

10. The web printing system of claim 8, the controller being further configured to deactivate the at least one actuator in response to the electrical signal generated by the first sensor corresponding to a level of tension that is less than the first predetermined threshold after the electrical signal generated by the sensor exceeds the first predetermined threshold.

11. The web printing system of claim 8 further comprising:

a second sensor operatively connected to the controller and to the second roller in the plurality of rollers, the second sensor being configured to generate an electrical signal that varies with reference to a tension applied to the second roller by the media web; and the controller being further configured to identify a second level of tension applied to the second roller with reference to the second electrical signal, compare the second identified level of tension to a second predetermined threshold, and operate the other actuator to rotate the second roller in the plurality of rollers at the rotational speed that is proportional to the tension applied by the media web to the second roller in response to the signal generated by the second sensor that varies with reference to the level of tension applied by the media web to the first roller exceeding the second predetermined threshold.

12. The web printing system of claim 11, wherein the second predetermined threshold is different than the first predetermined threshold.

* * * * *